US006688074B1

(12) United States Patent
Button et al.

(10) Patent No.: US 6,688,074 B1
(45) Date of Patent: Feb. 10, 2004

(54) CASE PACKING MACHINE AND METHOD

(75) Inventors: Donald C. Button, Cheshire, CT (US); Nilang Dalwadi, East Hartford, CT (US); Rick Dolce, East Hampton, CT (US); John Prete, Higganum, CT (US); Al Bozzi, Middletown, CT (US); Nick Pini, Portland, CT (US); Emilio Francesco, Middletown, CT (US); Jeff Reilly, Meriden, CT (US); Joe Spagua, Berlin, CT (US); J. Michael Weaver, Madison, CT (US)

(73) Assignee: Standard Knapp Inc., Portland, CT (US)

( * ) Notice: Subject to any disclaimer, the term of this patent is extended or adjusted under 35 U.S.C. 154(b) by 123 days.

(21) Appl. No.: 09/660,871

(22) Filed: Sep. 13, 2000

Related U.S. Application Data

(62) Division of application No. 09/533,524, filed on Mar. 23, 2000, now Pat. No. 6,373,205, which is a division of application No. 09/185,483, filed on Nov. 4, 1998, now Pat. No. 6,098,375.

(51) Int. Cl.[7] ..... B65B 21/00

(52) U.S. Cl. ..... 53/48.1; 53/247; 53/251; 53/284.5; 53/468

(58) Field of Search ..... 53/266.1, 48.1, 53/284.5, 247, 250, 251, 468

(56) References Cited

U.S. PATENT DOCUMENTS

| | | | | | |
|---|---|---|---|---|---|
| 3,201,916 | A | | 8/1965 | McGill | 53/382.2 |
| 3,653,178 | A | * | 4/1972 | Bauer | 53/159 |
| 3,852,942 | A | | 12/1974 | Johnson et al. | 53/382.2 |
| 3,863,427 | A | | 2/1975 | Rossi | 53/382.2 |
| 3,948,018 | A | * | 4/1976 | Rowekamp | 53/61 |
| 4,389,832 | A | * | 6/1983 | Calvert | 53/48 |
| 4,522,014 | A | | 6/1985 | Robinson | 53/382.2 |
| 4,570,413 | A | * | 2/1986 | Raudat | 53/247 |
| 4,587,792 | A | | 5/1986 | Hartness et al. | |
| 4,671,042 | A | | 6/1987 | Moekle et al. | |
| 4,691,495 | A | * | 9/1987 | Schuh | 53/48 |
| 4,709,536 | A | | 12/1987 | Hartness et al. | |
| 4,835,946 | A | | 6/1989 | Hartness et al. | |
| 4,896,474 | A | * | 1/1990 | Osteen et al. | 53/48 |
| 5,148,654 | A | | 9/1992 | Kisters | |
| 5,269,742 | A | | 12/1993 | Crouch et al. | |
| 5,381,639 | A | * | 1/1995 | Calvert et al. | 53/48.1 |
| 5,454,210 | A | | 10/1995 | Piazza | 53/251 |
| 5,555,700 | A | * | 9/1996 | Marti | 53/48.1 |
| 5,655,355 | A | | 8/1997 | Ramler | 53/251 |
| 5,782,732 | A | * | 7/1998 | Herrin | 493/131 |
| 5,971,906 | A | * | 10/1999 | Tharpe, Jr. et al. | 493/131 |

* cited by examiner

*Primary Examiner*—Rinaldi I. Rada
*Assistant Examiner*—Christopher Harmon
(74) *Attorney, Agent, or Firm*—Cantor Colburn LLP

(57) ABSTRACT

An improved case packer machine is disclosed, of the type where containers are dropped through grid fingers to an empty case positioned on a lift table. The case packer machine of the present invention includes a flap opener which includes a pair of shoes mounted to an air cylinder. The shoes are extended by the air cylinder to contact and open the leading flap. The lifting table of the present invention is motor driven and controlled to limit the shock loading experienced by the containers as they are positioned within the cases. The lifting table includes a pair spur gears driven by the motor in meshing arrangement with a pair rack gears each mounted to a table and a novel gear guide to maintain proper engagement between the racks and gears and further to provide for backlash adjustment between the gears.

6 Claims, 5 Drawing Sheets

CASE PACKING MACHINE AND METHOD

CROSS-REFERENCE TO RELATED APPLICATIONS

This Application is a divisional of U.S. application Ser. No. 09/553,524 filed Mar. 23, 2000 now U.S. Pat. No. 6,373,205, which is a divisional application of U.S. application Ser. No. 09/185,483 filed Nov. 4, 1998 (now U.S. Pat. No. 6,098,375), which are hereby incorporated by reference in their entirety.

BACKGROUND

A case packer is designed to pack containers (typically bottles or cans) into cases or trays at speeds up to 40 cases per minute (cpm), depending on product specifications.

The typical case packer can be broken down into five major sections, the product infeed, case feed, lift table, grid and operator interface sections.

The product infeed section carries product toward the machine and separates it into the desired pack pattern using stainless steel lane guides. Product is typically monitored for volume and position throughout this section by a series of electronic sensors.

The case feed section transports empty cases into the lift table on a conveyor and discharges cases out of the machine after product has filled the cases. Cases are indexed into the lift table section using a series of stops, which prohibit cases from advancing in the case feed when activated. Case volume and positioning is monitored throughout this section by a series of electronic sensors.

The lift table section of prior art case packers lifts the cases to a point beneath the grid area and waits for product to enter the case before descending. This section is equipped with an air over oil lift table which prompts the up and down motion of the table. As the grid area is filled with product, the lift table rises. Once the product has successfully entered the case, the lift table lowers. The case feed then discharges the filled cases.

The grid section is responsible for releasing product into the empty cases on the lift table. This section is made up of two primary components: the riding strip on which the product rests as it enters the grid area; and the grid basket through which product descends once the riding strips are shifted. The grid components are typically changed to accommodate a new product size, depending on product specifications.

The operator interface section controls a system to manage the operation of the machine. In certain case packers of the prior art the interface is mounted on a swing boom which enables the operator to control the machine from either side.

Containers are fed into the product infeed from a product conveyor system. As the containers advance downstream, they are arranged into a nested pattern using a series of guides. The containers are monitored throughout the infeed using sensors such as a high-level detector, low level detector, void detectors and a down product detector.

The low level detector monitors the volume of containers entering the machine. If a shortage of product flow occurs, the machine will automatically come to a controlled end of-cycle stop and wait for additional product. The machine will then automatically restart when additional product is supplied. The void detectors monitor the volume of product entering the machine. In the event that the low-level detector is blocked indicating sufficient containers and a void detector senses no containers, the void detector will signal an infeed oscillator cylinder to actuate lane guides to move back and forth, freeing any potential container jams. If a jam is present, the freed containers will then flow downstream, block the void detectors and stop the infeed oscillator from actuating. The down product detector prevents fallen containers from entering the grid area. In the event of a fallen container, a detector signals the machine to come to a stop. The case feeds section is responsible for transporting empty cases into the machine. Empty cases enter the case feed from a conveyor and the first case comes to rest against a stop. The second case then comes to rest against the first case and relieves a low level condition signal allowing the two empty cases to enter the lift table section and come to rest against a lift table case stop. A pair of case brakes grasp the side of a subsequent case whenever a case in front of it is fed into a lift table. This prevents additional cases from flowing onto the lift table and interfering with normal operation. One problem with the case brakes of the prior art is the time consumption and difficulty associated with accommodating cases of different sizes.

The cases then exit the case feed section and enter the lift table. Once the first and second cases are positioned on lift table the lift table is raised upward toward the grid. At the same time a case clamp is closed, prohibiting the cases positioned on the lift table from moving backwards. As the cases exit the case feed the forward flap of the cases must be opened prior to presentation to the lift table. Typically an air cylinder having a helix drive and a shoe mounted to the end is employed. The air cylinder propels the shoe towards the leading flap end of the forward moving case and simultaneously rotates the shoe to lift and open the leading flap. Some of the problems with this type of flap opener include the relatively high expense of the helix air cylinder, high part wear and the timing and adjustment problems associated with case size changes.

Once the lift table advances upward two additional empty cases are allowed to advance downstream against the infeed case stop. Once the lift bale returns to its down position, both filled cases will be discharged at the same time that two empty cases will be entering the lift table. Once the first case is cleared, the lift table case stop will close and empty cases will then enter the lift table. The operation cycle will then repeat, based on the amount of containers in the product infeed. If there is a low product condition, the case feed will wait until all conditions in the product infeed and grid are satisfied before continuing.

The lift table section is responsible for positioning empty cases at a point beneath a grid basket. This section of the machine typically consists of an air over oil lift cylinder, which is controlled through the operation of several photoeyes and timers controlled, for example, by a programmable logic controller (PLC). The grid is activated to shift and to release the containers as will be more fully discussed herein below and filled cases are discharged from the machine on a conveyor. The grid section is responsible for arranging containers in their final pack pattern and ensuring that the containers lower into the case smoothly and in order. The grid consists of two primary components, the riding strips and the grid basket. The product infeed advances containers downstream onto the riding strips within the grid section. Overhead brakes lower into contact with incoming containers thereby prohibiting additional containers from entering the section. Once the overhead brakes are lowered, the riding strips are shifted to one side approximately ½ the diameter of the product. This allows the containers positioned in the grid to lower through the riding strips and grid basket into the empty cases positioned on the lift table.

Once the containers pass through the grid into the cases the riding strips are returned to their original position and the overhead brakes are raised and subsequent containers are moved from the product infeed into the grid. The process will then repeat itself, depending on the amount of containers entering the grid.

The lift table of the prior art as described herein has deficiencies associated with the high levels of shock loading transmitted to containers delivered from the grid and also from the stand point of machine speed. The containers, as they are dropped into the cases, experience shock loads on the average of about 15 to 25 times the force of gravity. Typical containers are comprised of glass and thin walled plastic which may shatter or rupture due to these types of shock loadings. The shock loading not only dictates container design but also a robust drive system for the table which increases the weight and momentum of the system, all causing wear and timing problems. The lift table experiences approximately 1500 pounds of shock loading, as the containers impact the cases, each cycle at a rate of up to 40 cases per minute.

Control of the case packer machine is managed through the operator interface, which is sometimes mounted on a swing boom on the side of the machine. This interface consists of a series of pushbuttons which enable the operator to start, stop, alter the performance of machine, and locate/correct any fault conditions.

SUMMARY OF THE INVENTION

The above discussed and other drawbacks and deficiencies of the prior art are overcome or alleviated by the present invention.

This invention relates generally to machines for packing containers into cases. In particular this invention relates specifically to improvements to a case packer of the type where containers are dropped through grid fingers to an empty case positioned on a lift table. The improvements include a device for opening flaps on the case and a lift table section including an improved lift table drive assembly.

The case packer machine of the present invention includes a flap opener which includes a pair of shoes mounted to an air cylinder. The shoes are extended by the air cylinder to overtake the cases as they are advanced through the case packer machine to contact and open the leading flap. The shoes are biased in a retracted position by a tension spring and as the shoes contact the leading flap they work to rotate the leading flap toward an open position. As the shoes contact the leading flap they pivot about a pivot pin in a rod end of the air cylinder and disposed within a slot on the shoes. The shoes continue to extend to the point where they contact the leading corner of the case wherein the shoes rotate along a path defined by a cam slot and move the leading flap to an open position. When the cylinder is retracted the shoes are retracted by the biasing force provided by the spring.

The lifting table of the present invention is motor driven and controlled to limit the shock loading experienced by the containers as they are positioned within the cases. The lifting table includes a pair spur gears driven by the motor in meshing arrangement with a pair rack gears each mounted to a table and a novel gear guide to maintain proper engagement between the racks and gears and further to provide for backlash adjustment between the gears. A vibration and shock absorbing mount is used to position the motor to the machine to eliminate shock loading effects on the drive system and on the containers themselves.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
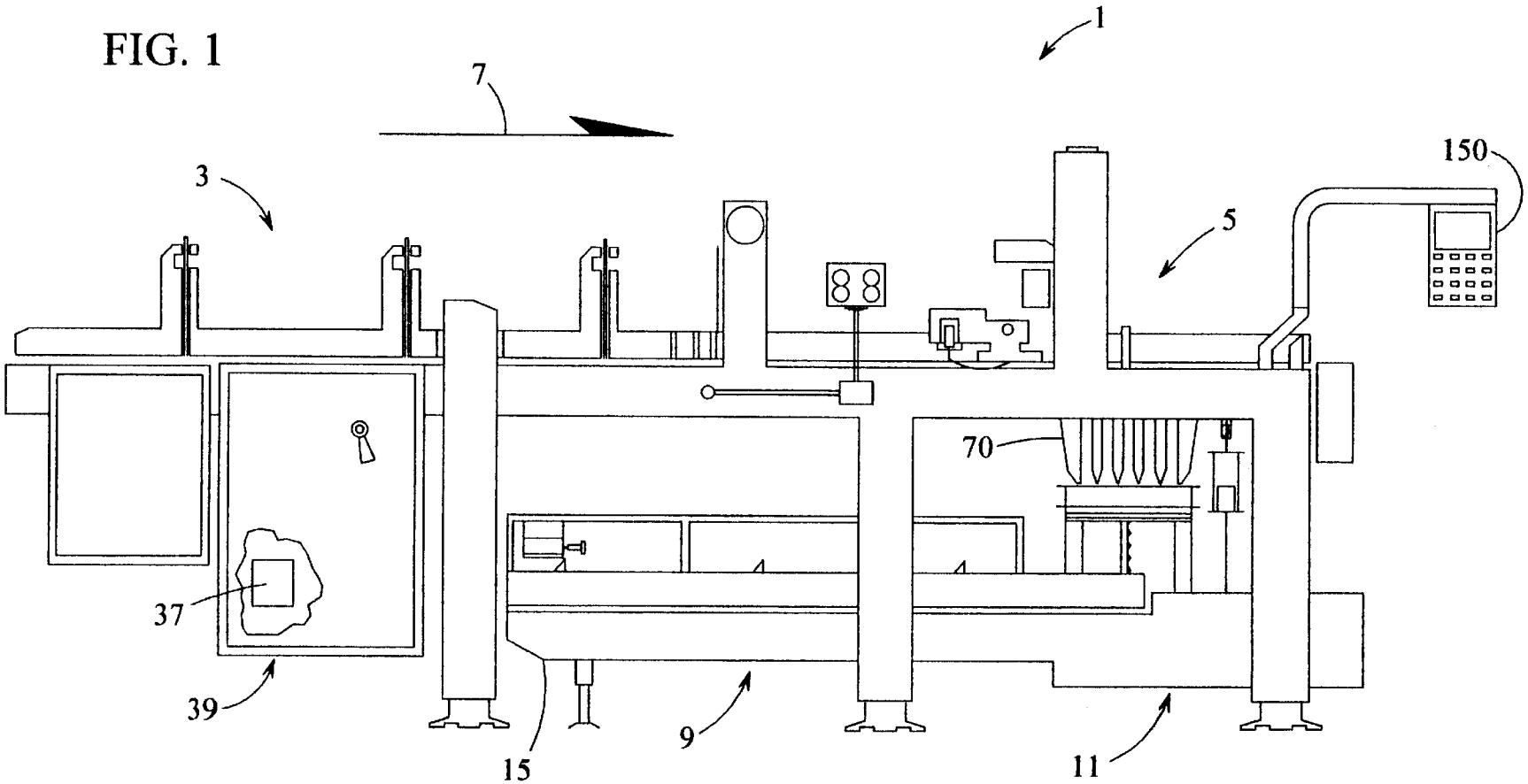
FIG. 1 is a side plan view of a case packer machine of the present invention.

Referring to FIG. 1 there is shown a case packer, or drop packer, generally indicated as 1 having a product infeed section 3 for delivering containers 138, 140 (FIG. 3) to a grid section 5 in the direction of product flow indicated by arrow 7. Case packer 1 further includes case feed section 9 for delivering empty cases to lift table section 11 also in the direction of product flow indicated by arrow 7. As described herein above with respect to case packers of the prior art, empty cases are delivered to the lift table section 11 which raises the cases to the grid section 5 to receive containers from the grid section. Also included in drop packer 1 of the present invention is leading flap opener 15 to ensure that the cases presented to lift table section 11 are capable of receiving containers from grid section 5.

Figure 2:
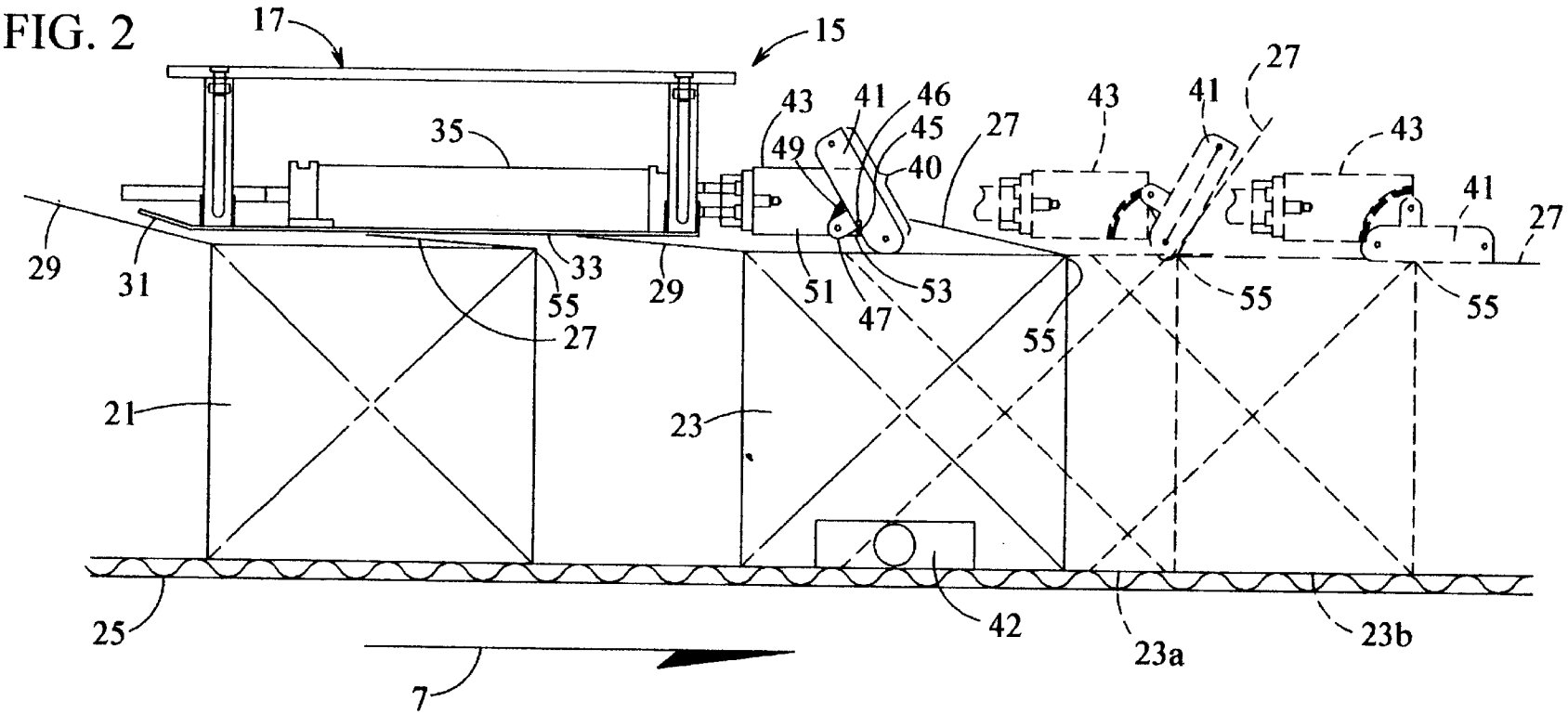
FIG. 2 is a side plan view of an embodiment of the flap opener of the present invention.
Figure 2A:
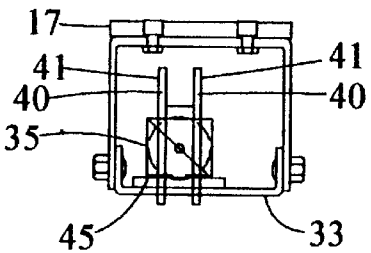
FIG. 2A is an end plan view of the flap opener of FIG. 2.

Referring to FIGS. 2 and 2A, there is shown case feed section flap opener 15 positioned within mounting frame 17 including trailing flap opener 31. Empty cases 21, 23 are conveyed along flat top chain 25 to flap opener 15 in the direction of product flow indicated by arrow 7 toward lift table section 11 (FIG. 1) with leading flap 27 and trailing flap 29 in the closed and unsealed condition. Upon entering flap opener 15, trailing flap opener 31, in the form of a tang extending rearward from skid portion 33, contacts trailing flap 29 and the relative motion between empty case 21 and the trailing flap opener causes the trailing flap to rotate to the open position. As empty case 21 continues to travel along chain 25, a skid portion 33 ensures that trailing flap 29 remains open. Leading flap 27 of case 23 remains in the closed position due to the relative motion between the case and flap opener 15. Once case 23 advances to the position shown in FIG. 2 air cylinder 35 is triggered to extend by a controller 37, such as a PLC, contained in enclosure 39 (FIG. 1). Air cylinder 35 extends at a greater rate than the speed at which case 23 travels and as such shoes 41 mounted to rod end fitting contact leading flap 27 to indicate rotation of the leading flap.

Shoes 41 are pivotly mounted to rod end fitting 43 by pivot pin 45 disposed mounting slot 46 and the path of the rotational movement of the shoes is controlled by follower 47 disposed within the rod end fitting which runs inside of cam slot 49. Mounting slot 46 and cam slot 49 are defined within the shoes 41. Shoes 41 are biased in a retracted position while air cylinder 35 is in the retracted position by tension spring 51 attached to ear portion 53 of the shoes. As case 23 advances, to the position shown as 23*a,* air cylinder 35 extends to the position shown in phantom and contact surface 40 of shoes 41 contact case 23*a* at leading corner 55 below pivot pin 46 and overcomes the biasing force of spring 51 causing the shoes to pivot within mounting slot 46 and move along cam slot 49 and rotates leading flap 27 toward the open position. As empty case 23 is advanced to position 23*b* air cylinder 35 extends pivot pin 45 past leading corner 55 causing shoes 41 to rotate to a fully extended position and thereby positioning leading flap 27 in a fully open position. Once leading flap 27 is fully opened rails (not shown) maintain the flap in an open position as in the prior art for presentation to the lift table section and cylinder 35 is triggered to retract by controller 37 and spring 51 returns shoes 41 to the retracted position. The sequence is repeated for each empty case to ensure the leading flap 27 is in the open position prior to presentation with the lift table section 15 to allow for filling of the case as described herein above.

In another embodiment of the present invention case 23 is interrupted in its travel in the direction indicated by arrow 7 by a case brake 42 as in the prior art described herein above. While case 23 is held by case brake 42 air cylinder 35 extends as described herein above and contact surface 40 of shoes 41 contact case 23 at leasing corner 55 below pivot pin 46 and overcomes the biasing force of spring 51 causing the shoes to pivot within mounting slot 46 and move along cam slot 49 and rotates leading flap 27 toward the open position. As air cylinder 35 continues to extend pivot pin 45 travels past leading corner 55 causing shoes 41 to rotate to a fully extended position and thereby positioning leading flap 27 in an open position. Once leading flap 27 is in the open position rails (not shown) maintain the flap in the open position as in the prior art for presentation to the lift table section and cylinder 35 is triggered to retract by controller 37 and spring 51 returns shoes 41 to the retracted position. The sequence is repeated for each empty case to ensure the leading flap 27 is in the open position prior to presentation with the lift table section 15 to allow for filling of the case as described herein above.

Figure 3:
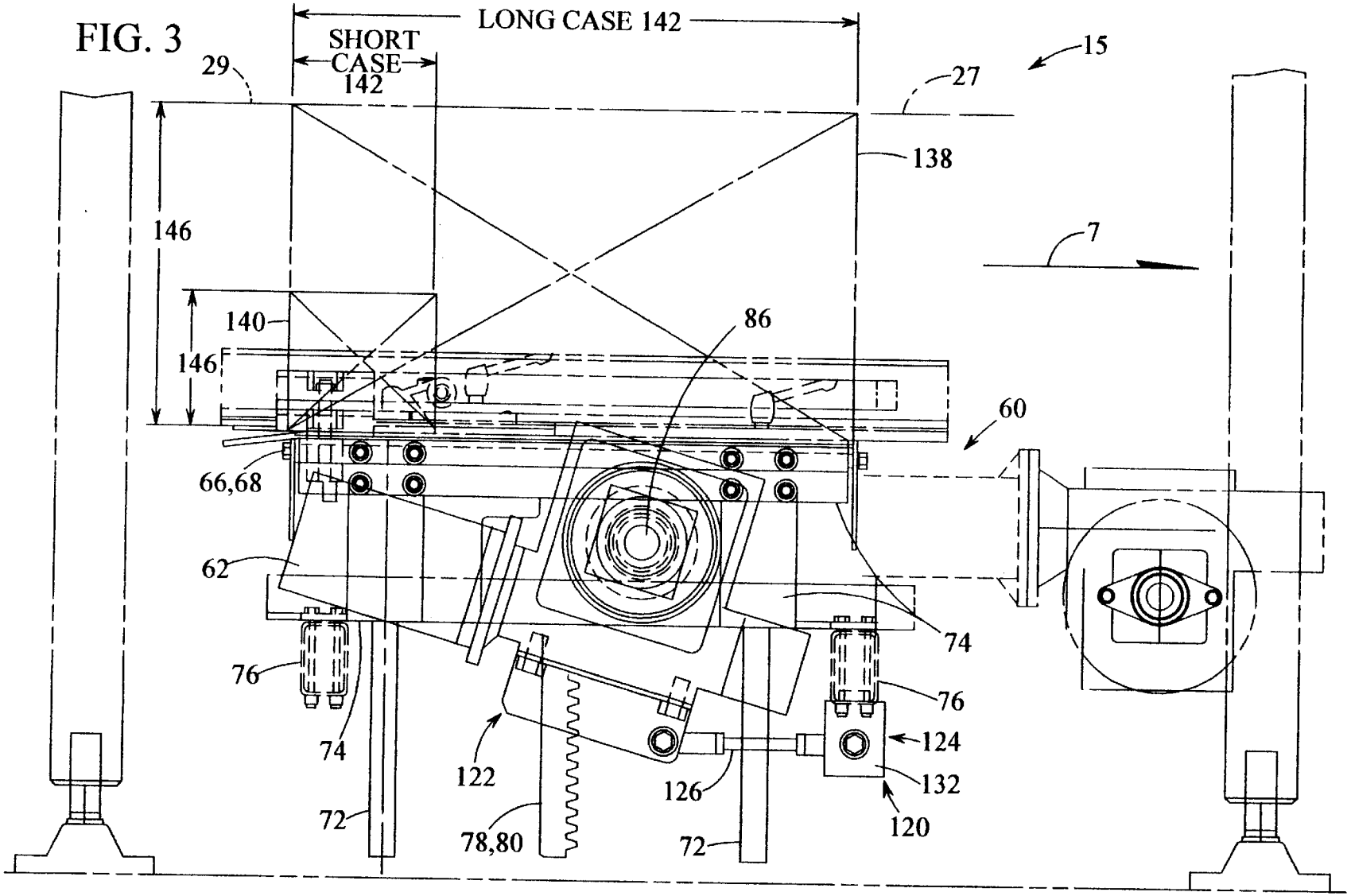
FIG. 3 is a side plan view of an embodiment of the lift table section of a case packer machine in accordance with the present invention.

Referring to FIG. 3 there is shown lift table section 15 of case packer 1 of the present invention incorporating a compensating lift table assembly 60 which is shown in the down position. Compensating lift table assembly 60 includes motor 62, shown as a servo motor, and a right angle gear box 64 to raise and lower table assemblies 66, 68 between case feed section 9 and grid fingers 70 of grid section 5 (FIG. 1). Although motor 62 is shown as a DC servo motor the scope of the present invention includes other alternatives such as AC servo motors, AC vector drives, air driven motors, and their equivalents.

Figure 4:
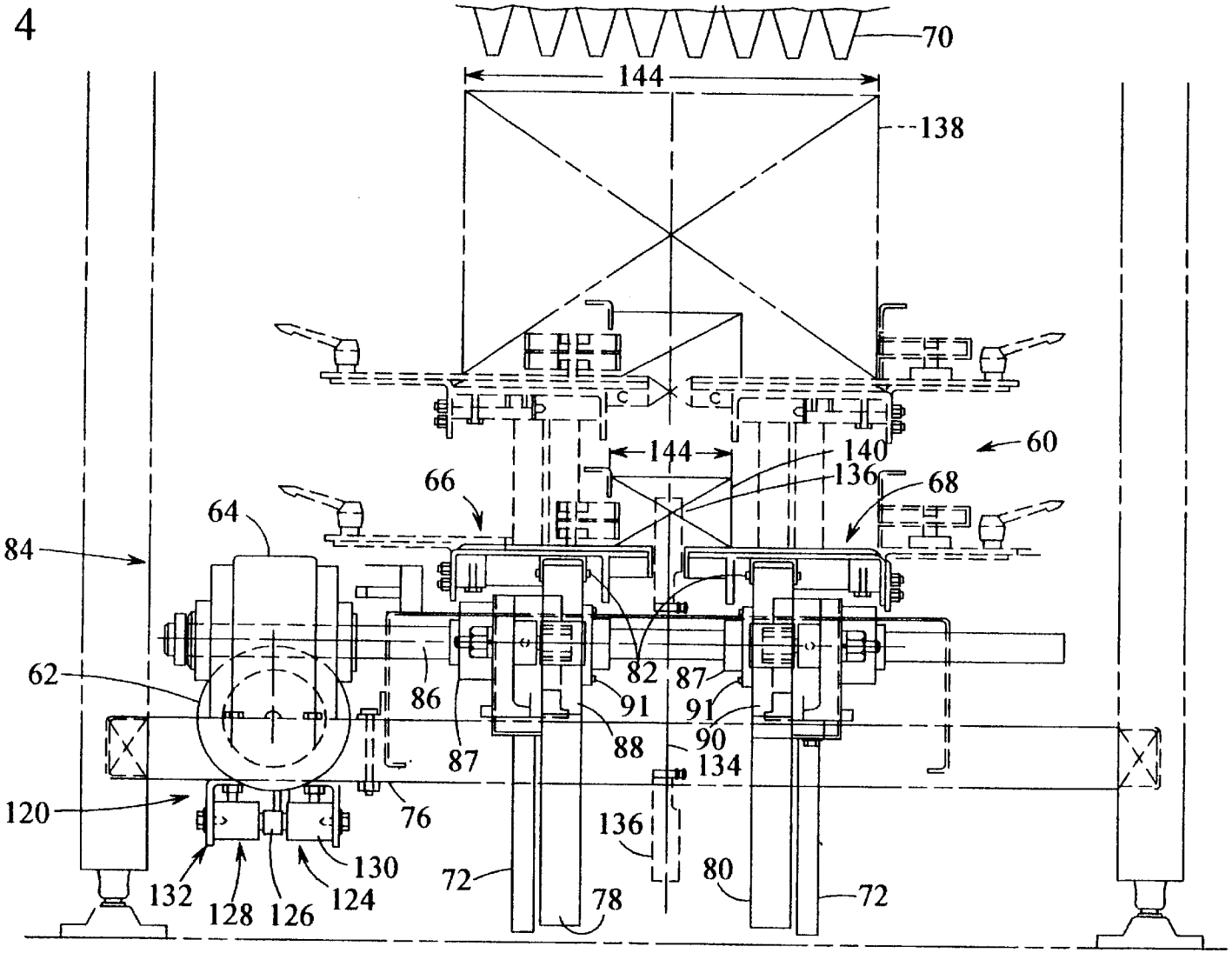
FIG. 4 is an end plan view of the lift table section of a case packer machine in accordance with the present invention.
Figure 5:
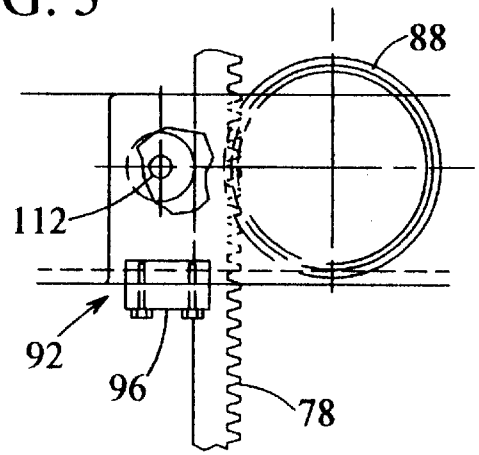
FIG. 5 is a side plan view in partial section of the drive assembly of a case packer machine in accordance with the present invention.
Figure 6:
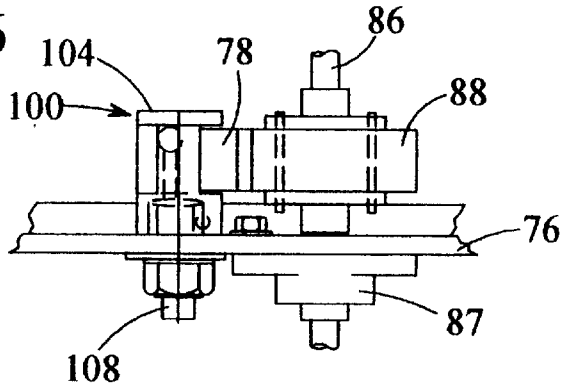
FIG. 6 is a top plan view in partial section of the drive assembly of a case packer machine in accordance with the present invention.

As best shown in FIGS. 3 and 4 table assemblies 66, 68 are mounted to lift rods 72 and ride within linear bearings 74 mounted to machine frame 76 and are further mounted to rack gears 78, 80 by mounting pins 82. Lift table drive assembly 84, in the embodiment shown, includes motor 62 and gear box 64 which transfer torque to shaft 86 disposed within bearings 87 attached to frame 76 and further having spur gears 88, 90 mounted thereto by spur gear retainers 91. Spur gear 88 is disposed on shaft 86 in meshing arrangement with rack gear 78 as best shown in FIGS. 5 and 6. Spur gear 90 is similarly arranged on shaft 86 with respect to rack gear 80. In one embodiment of the present invention rack gears 78, 80 and spur gears 88, 90 are comprised of a nylon material to resist fretting and fatique in the highly loaded cyclic environment of a drop packer.

Although lift table drive system 84 is shown as a rack and spur gear other drive systems are within the scope of the present invention. Other alternative embodiments of drive system equivalents include a bellcrank system, a ball screw arrangement, a cam and follower system, an eccentric drive system, or a roller chain and gear arrangement and other equivalents coupled to a servo type drive and controlled as described herein below.

Figure 7:
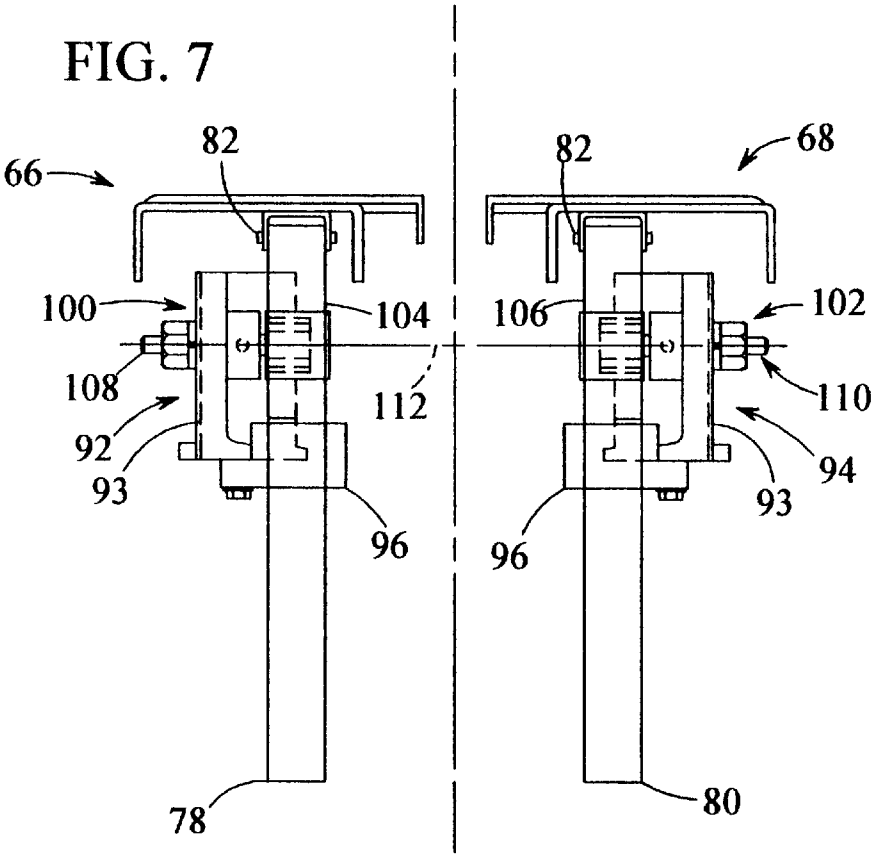
FIG. 7 is an end plan view showing the lift table assemblies and rack gear supports.

As discussed herein above with respect to the prior art, lift tables generally experience high shock loading which leads to premature part wear, requires slower machine speeds and may lead to container damage. The lift table assembly 60 of the present invention incorporates many features to reduce or eliminate the problems associated with the shock loading. Referring again to FIGS. 5 and 6 and with further reference to FIG. 7, rack gear guide assemblies 92, 94 are but one feature of the present invention which reduce the problems associated with shock loading. The rack gear assemblies 92, 94 are shown including lateral guides 96, 98 comprised of U-shaped members mounted to guide frame 93 to stabilize rack gears 78, 80 in the lateral direction as shown. Guide frame 93 is mounted to machine frame 72. Rack gear guide assemblies 92, 94 also include roller assemblies 100, 102 to maintain proper engagement between the racks and gears and further to provide for backlash adjustment between the gears. Roller assemblies 100, 102 include rollers 104, 106 mounted to eccentric studs 108, 110 within guide frames 93. Rollers 104, 106 rotate about centerline 112 parallel to rack gears 78, 80 and may be adjusted to increase or decrease contact with the rack gears by applying a wrench (not shown) to eccentric studs 108, 110. Increasing the contact between the rollers and the rack gears increases the engagement and decreases the backlash of the gear pairs. The ability to adjust the amount of engagement and backlash increases reliability and accuracy of the lift table and decreases wear and associated maintenance.

Referring back to FIGS. 3 and 4, it is shown that motor 62 and gearbox 64 are mounted to machine frame 76 via vibration isolating assembly 120 including reaction arm bracket 122 linked to vibration mount assembly 124 via tie rod 126. As best shown in FIG. 4, tie rod 126 is connected to vibration mount assembly 124 via control mounts 128, 130 which are connected to machine frame 76 via reaction arm bracket 132. Control mounts 128, 130 are comprised of a material capable of absorbing the cyclic shock loads transmitted to the motor 62 and gear box 64 such as rubber or other shock absorbing material. For example, control mounts 128, 130 are comprised from a neoprene material in one embodiment of the present invention.

Right hand lift table assembly 66 and left hand lift table assembly 68 are mounted to machine frame 76 via lift rods 72 which ride within linear bearings 74 as described herein above about centerline 134 (FIG. 4). Mounted in this fashion paddles 136, driven by servo motor 148, pass between the lift table assemblies to remove filled cases 138, 140 from the lift table section as in the prior art described herein above.

An operator (not shown) selects a setting from operator interface 150 (FIG. 1) corresponding to a particular case size and quantity of containers to be loaded into each case 121. Case packer 1 accommodates various sizes cases ranging from 138 to 140, specifically from about 6 inches to 24 inches in length 150, from 6 inches to 19 inches in width 144, and up to 14 inches in height 146. The operator interface 142 then transmits a corresponding signal to controller 37. Among other settings of case packer 1, controller 37 controllers the maximum height to which lift table assembly 60 extends, as shown in phantom in FIG. 4, as well as the speed and accelerations of the movement of the assembly as will be more fully explained herein below.

With reference to FIG. 1, during operation containers move along the product infeed section 3 to the grid section 5 as in the prior art described herein above. Similarly empty cases move through the case feed section 9, the leading and trailing flaps are opened by flap opener 15, and the cases are indexed into the lift table section 11. Now referring to FIGS. 3 and 4, a case 138 enters the lift table section 15 and rests on top of lift table assemblies 66, 68. Controller 37 then sends signals to motor 64 to lift case 138 upward toward grid fingers 70. In an embodiment of the present invention motor 62 comprises a servo motor and in conjunction with controller 37 limits the height to which the table assemblies 66, 68 are lifted depending on case and product dimensions selected by the operator.

In operation, drive assembly 84 lifts table assemblies 66, 68 upward toward grid fingers 70 and riding strips (not shown), as in the prior art and described herein above, are shifted to release containers into the grid fingers. As the containers are released from grid fingers, controller 37 accelerates drive assembly 84 at a predetermined rate to lower lift table assemblies 66, 68 to anticipate the dropping containers. The table assemblies are accelerated at such a rate as to minimize the shock load associated with the containers impacting the cases 138, 140. In an embodiment of the present invention the lift table assemblies are accelerated at such a rate as to have a velocity equal to the velocity of the containers at contact with the case. Drive assembly 84 then decelerates table assemblies 66, 68, including filled case 138, 140, as they reach the down to reduce the shock loading on the containers as the lift table assemblies bottom out. In this manner the apparent velocity between the case and the containers at first contact is nearly zero and the loading on the containers is controlled by the predetermined rate of deceleration of the lift table assemblies. Once filled, case 138, 140 reaches the down position paddle 136, driven by servo motor 148, passes between the lift table assemblies to remove the filled cases from the lift table section as in the prior art described herein above. The above sequence is repeated until the desired number of cases are filled.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method of packing containers in a case using a case packing machine, a case feed section, a lift table section and a grid section, the method comprising:

advancing a plurality of containers to the grid section;

advancing the case to the lift table section;

lifting the case proximate the grid section;

releasing the containers from the grid section in a downward direction so that the containers fall into the case; and lowering the case at a predetermined rate after said releasing the containers and before the containers contact a bottom side of the case.

2. A method of packing containers in a case using a case packing machine, a case feed section, a lift table section and a grid section, the method comprising:

advancing a plurality of containers to the grid section;

advancing the case to the lift table section;

lifting the case proximate the grid section;

releasing the containers from the grid section in a downward direction so that the containers fall into the case;

lowering the case after said releasing the containers and before the containers contact a bottom side of the case;

decelerating a downward motion of the case at a predetermined rate;

stopping the downward motion of the case.

3. A method of packing containers in a case using a case packing machine, a case feed section, a lift table section and a grid section, the method comprising:

advancing a plurality of containers to the grid section;

advancing the case to the lift table section;

lifting the case proximate the grid section;

releasing the containers from the grid section in a downward direction so that the containers fall into the case;

lowering the case at a predetermined rate after said releasing the containers and before the containers contact a bottom side of the case;

decelerating a downward motion of the case at a predetermined rate; and stopping the downward motion of the case.

4. The method of claim 3 further comprising advancing the case in the product flow direction out of the lift table section.

5. The method of claim 2, wherein said decelerating the downward motion of the case occurs after the containers contact the bottom side of the case.

6. The method of claim 3, wherein said decelerating the downward motion of the case occurs after the containers contact the bottom side of the case.

* * * * *